US011758345B2

(12) United States Patent
Alur et al.

(10) Patent No.: US 11,758,345 B2
(45) Date of Patent: Sep. 12, 2023

(54) PROCESSING AUDIO FOR LIVE-SOUNDING PRODUCTION

(71) Applicants: Raj Alur, San Jose, CA (US); Roderick Randall, Hopkinton, MA (US)

(72) Inventors: Raj Alur, San Jose, CA (US); Roderick Randall, Hopkinton, MA (US)

( * ) Notice: Subject to any disclaimer, the term of this patent is extended or adjusted under 35 U.S.C. 154(b) by 0 days.

(21) Appl. No.: 17/499,327

(22) Filed: Oct. 12, 2021

(65) Prior Publication Data

US 2022/0116726 A1 Apr. 14, 2022

Related U.S. Application Data

(60) Provisional application No. 63/090,129, filed on Oct. 9, 2020.

(51) Int. Cl.

| | |
|---|---|
| ***H04R 5/02*** | (2006.01) |
| ***H04S 7/00*** | (2006.01) |
| ***G10L 19/008*** | (2013.01) |
| ***H04R 3/04*** | (2006.01) |
| ***H04R 5/04*** | (2006.01) |
| ***H04S 3/00*** | (2006.01) |
| ***H04R 3/12*** | (2006.01) |

(52) U.S. Cl.

CPC ..... *H04S 7/30* (2013.01); *G10L 19/008* (2013.01); *H04R 3/04* (2013.01); *H04R 3/12* (2013.01); *H04R 5/02* (2013.01); *H04R 5/04* (2013.01); *H04S 3/008* (2013.01); *H04S 2400/01* (2013.01); *H04S 2400/11* (2013.01); *H04S 2400/15* (2013.01)

(58) Field of Classification Search

CPC .... H04S 2500/15; H04S 2400/11; H04R 5/02

See application file for complete search history.

(56) References Cited

U.S. PATENT DOCUMENTS

| | | | | |
|---|---|---|---|---|
| 6,005,950 | A | 12/1999 | Cuniberti | |
| 6,069,310 | A | 5/2000 | Charles | |
| 7,853,342 | B2 | 12/2010 | Redmann | |
| 8,301,790 | B2 | 10/2012 | Morrison et al. | |
| 8,678,896 | B2 | 3/2014 | Pitsch et al. | |
| 10,140,087 | B2 | 11/2018 | Barrett | |
| 2003/0123673 | A1* | 7/2003 | Kojima | H04R 5/02 381/26 |
| 2010/0223552 | A1* | 9/2010 | Metcalf | H04S 3/008 715/716 |
| 2011/0002469 | A1* | 1/2011 | Ojala | H04S 7/30 381/23 |

(Continued)

FOREIGN PATENT DOCUMENTS

| | | | |
|---|---|---|---|
| CN | 104125534 | A | 10/2014 |
| JP | H0340597 | * | 2/1991 |
| JP | 2009244712 | A | 10/2009 |

OTHER PUBLICATIONS

Machine translation of JPH0340597, 6 pages (Year: 1991).*

*Primary Examiner* — Ping Lee
(74) *Attorney, Agent, or Firm* — BainwoodHuang

(57) ABSTRACT

A technique for producing audio includes providing multiple audio tracks of respective sound sources of an audio performance and rendering a sound production of the audio performance at a listening venue by playing back the audio tracks on respective playback units.

19 Claims, 7 Drawing Sheets

(56) References Cited

U.S. PATENT DOCUMENTS

| | | | |
|---|---|---|---|
| 2014/0012907 | A1 | 1/2014 | Cavanaugh et al. |
| 2017/0098452 | A1* | 4/2017 | Tracey ..... G10L 19/26 |
| 2017/0248928 | A1 | 8/2017 | Holladay et al. |

* cited by examiner

PROCESSING AUDIO FOR LIVE-SOUNDING PRODUCTION

CROSS-REFERENCE TO RELATED APPLICATIONS

This application claims the benefit of U.S. Provisional Patent Application No. 63/090,129, filed Oct. 9, 2020, the contents and teachings of which are incorporated herein by reference in their entirety.

BACKGROUND

As audio technology has evolved, the ability to produce truly live-sounding audio reproductions has remained elusive. Regardless of the quality of loudspeakers and electronics, two-channel stereo is limited by design to two loudspeakers. With proper mastering and mixing, two-channel stereo can produce nearly-live sounding audio, but only at the center of the stereo image, where the listener is equidistant from the loudspeakers. Wandering away from this optimal location causes sound quality to degrade.

Surround sound standards, such as Dolby Atmos, DTS, and others, allow for additional loudspeakers (5.1, 7.1, or more) and thus have the potential to produce a more realistic sense of space. Ambience is generally synthetic in origin, though, with engineers building in delays and applying fading to convey the impression of physical presence. The impression is not entirely convincing, however, as artificially-added effects and geometrical constraints of loudspeaker placement tend to detract from realism. Also, surround sound is not well suited for large venues, such as sports clubs, jazz clubs, and other performance venues.

SUMMARY

Unfortunately, prior approaches to sound reproduction fail to provide a convincing experience of live audio. In contrast with the above-described approaches, an improved technique for producing audio includes providing multiple audio tracks of respective sound sources of an audio performance and rendering a sound production of the audio performance at a listening venue by playing back the audio tracks on respective playback units.

In one aspect, a method of producing audio includes receiving multiple audio tracks of respective sound sources, decoding the audio tracks, and providing the decoded audio tracks to respective playback units at a listening venue for reproducing respective audio of the decoded audio tracks.

In another aspect, a method of providing a remotely-sourced, live performance includes separately capturing audio tracks from respective sound sources at an originating location, encoding the captured audio tracks, and transmitting the encoded audio tracks over a network to a listening venue. The method further includes decoding the audio tracks of the respective sound sources at the listening venue, and providing the decoded audio tracks to respective playback units at the listening venue for reproducing respective audio of the decoded audio tracks.

Embodiments of the improved technique may be provided herein in the form of methods, as apparatus constructed and arranged to perform such methods, and as computer program products. The computer program products store instructions which, when executed on control circuitry of a computing machine, cause the computing machine to perform any of the methods described herein. Some embodiments involve activity that is performed at a single location, while other embodiments involve activity that is distributed over a computerized environment (e.g., over a network).

The foregoing summary is presented for illustrative purposes to assist the reader in readily understanding example features presented herein but is not intended to set forth required elements or to limit embodiments hereof in any way.

BRIEF DESCRIPTION OF THE SEVERAL VIEWS OF THE DRAWINGS

The foregoing and other features and advantages will be apparent from the following description of particular embodiments of the invention, as illustrated in the accompanying drawings, in which like reference characters refer to the same or similar parts throughout the different views. The drawings are not necessarily to scale, emphasis instead being placed upon illustrating the principles of various embodiments of the invention.

DETAILED DESCRIPTION OF THE INVENTION

Figure 1:
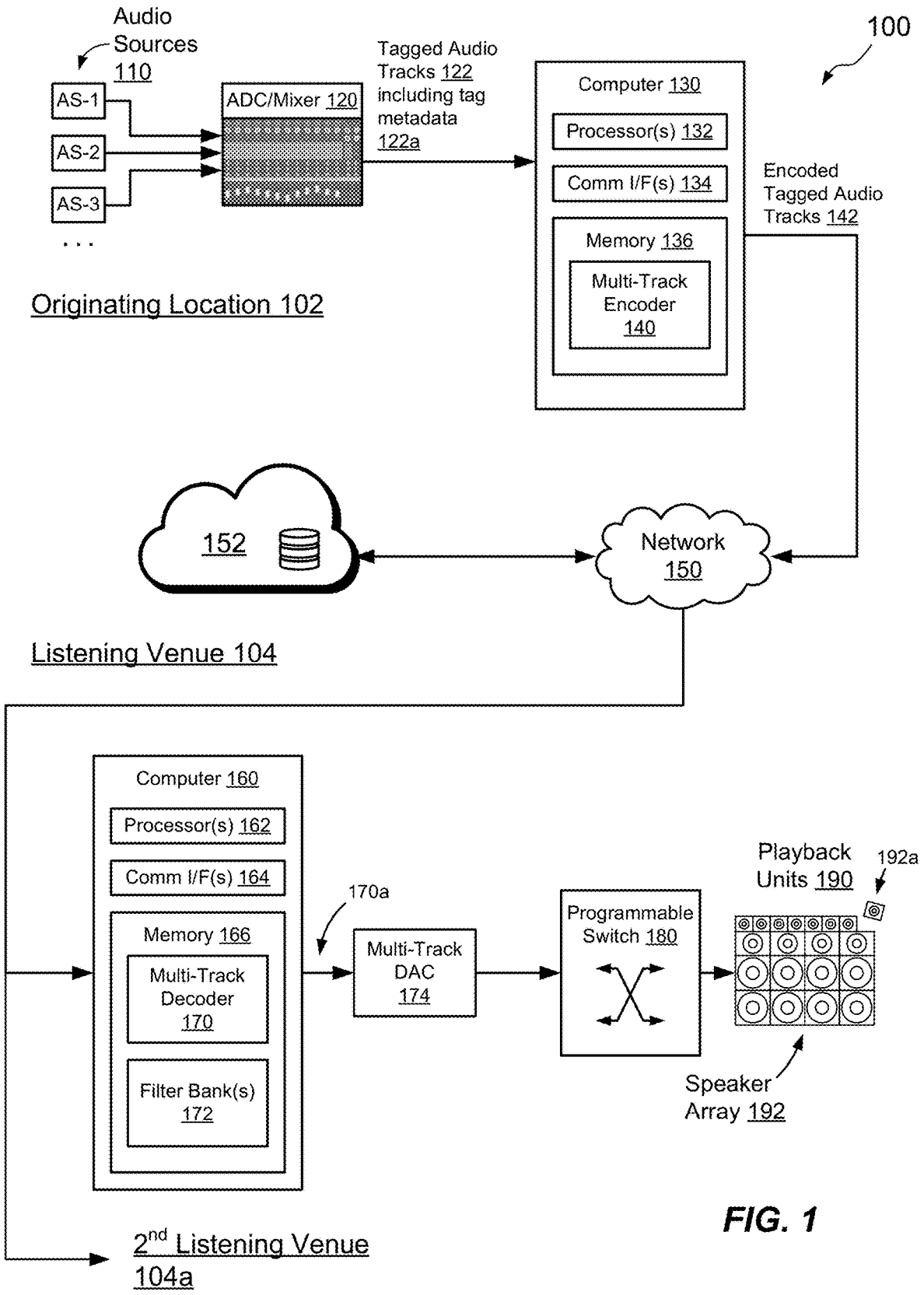
FIG. 1 is a block diagram of an example environment in which embodiments of the improved technique hereof can be practiced.

Embodiments of the invention will now be described. It is understood that such embodiments are provided by way of example to illustrate various features and principles of the invention, and that the invention hereof is broader than the specific example embodiments disclosed.

An improved technique for producing audio includes providing multiple audio tracks of respective sound sources of an audio performance and rendering a sound production of the audio performance at a listening venue by playing back the audio tracks on respective playback units.

In some examples, the listening venue is separated from the sound sources in space and/or time.

In an example, audio tracks may be captured at their respective sources, such as from a microphone of a vocalist, a pickup or microphone of a guitar, and/or other microphones placed near the persons or instruments producing sounds. In this manner, each track is made to capture an accurate signal from a respective performer (or group of performers). The captured signal inherently provides a high degree of separation relative to other tracks. The tracks may be individually digitized and encoded, and then transported or transmitted to a listening venue. A substantially reverse process may take place at the listening venue. For example, individual audio tracks may be decoded and played back by respective loudspeakers. According to some examples, the loudspeakers are placed in such a way as to correspond to the locations of sound sources (e.g., performers) at the originating location. Also, playback equipment such as amplifiers and speakers may be employed at the listening venue to match what is used, or could be used, at the source. In this manner, the audio performance at the listening venue essentially becomes a remotely-sourced live performance. The performance sounds real at the listening venue because it represents performers with respective loudspeakers and can use much of the same equipment to reproduce the sound as was used by the performers to produce it.

According to some examples, the listening venue is at a location apart from any of the sound sources, such that playback is remote. In some examples, the sound sources are co-located at an originating location. For instance, the originating location may be a studio, jazz club, sports venue, auditorium, or any location where an audio performance can take place.

In other examples, the sound sources include a first set of sound sources disposed at a first location and a second set of sound sources disposed at a second location. For instance, participants at two or more different locations may contribute to an audio performance, with results being blended together at the listening venue. Examples may include band performances, choral performances, a cappella performances, conference room meetings, or any group audio event where participants can contribute their portions separately or in sub-groups. In some cases, capturing the second set of sound sources includes playing back a recording of the first set of sound sources at the second location while the second set of sound sources is being created. For example, a band member can record his or her portion by playing along with a pre-recorded performance of one or more other band members. The pre-recorded performances may be captured and reproduced using the techniques described herein.

According to some examples, the improved technique further includes providing tag metadata for one or more of the audio tracks. The tag metadata includes, for example, information about sound sources, microphones, and/or any preprocessing of audio tracks derived from respective sound sources. In some examples, the tag metadata may be provided on a per-track basis. In some examples, the tag metadata captures (i) spatial locations of sound sources, (ii) amplifier and/or speaker types through which the respective tracks are to be played back, and/or (iii) characteristics of microphones used to capture the sound sources. The characteristics of microphones may include electronic characteristics as well as acoustic characteristics, such as locations and/or angles of microphones relative to the sound sources they are capturing, and relative to boundaries in the recording space, such as walls, ceilings, floors, and the like.

In some examples, a method performed at a source location includes separately capturing audio tracks from the respective sound sources, encoding the audio tracks, and transmitting the encoded audio tracks to the listening venue.

In some examples, a method performed at a listening venue includes decoding the audio tracks and providing the decoded audio tracks to respective playback units.

In some examples, the method at the playback venue further includes applying the tag metadata received with the audio tracks in reproducing the audio tracks. For example, the playback metadata for a particular track may specify that a certain filter be applied that simulates desired amplifier characteristics. The method may respond to that tag metadata by configuring a filter for that track which meets the specified requirements.

In some examples, the method at the playback venue further includes placing the playback units or portions thereof at locations in the listening venue that correspond to relative locations of the sound sources at the originating location. For example, loudspeakers may be placed at the listening venue in the same relative positions as performers at the originating location.

In some examples, the method at the playback venue further includes receiving N audio tracks of the audio performance and generating therefrom M playback tracks to be played back at the listening venue, M<=N. According to some examples, the method at the playback venue further includes mixing down the N audio tracks to the M playback tracks by merging at least two of the N audio tracks into a single audio track. Preferably, tracks are selected to be merged based on their not contributing much to spatial realism and based on it being unlikely that the tracks will distort each other.

In some examples, the method at the playback venue further includes providing a playback unit for each of the M playback tracks.

In some examples, the M playback units include at least two playback units that have different amplifier and/or speaker configurations. For example, the playback unit for a guitar track may include a guitar amp and a guitar speaker, whereas the playback unit for a vocal track may include a midrange driver and a tweeter.

In some examples, a particular playback unit of the M playback units is configured for a particular type of sound source (e.g., a bass guitar), and the method further includes playing back a playback track that conveys the particular type of sound source (e.g., bass guitar) by the particular playback unit. In this manner, the playback unit may be optimized for the type of sound source it plays back.

In some examples, playback for at least one of the M playback tracks involves applying a filter for modifying the audio track during playback. The filter may be configured to mimic a set of sound characteristics of a particular type of amplifier and/or loudspeaker, such as a commercially-available component used for live performances. The filter thus causes rendered audio to sound like it is coming from the particular type of amplifier and/or loudspeaker, even though playback is actually achieved using a non-customized amplifier and speaker.

According to some examples, the method further includes providing a reconfigurable speaker array that houses multiple loudspeakers of the playback units. For instance, the speaker array may include speakers having a variety of sizes for supporting accurate reproduction of a variety of sound sources.

In some examples, loudspeakers of the speaker array are physically separable to provide loudspeakers in a spaced-apart arrangement. For example, the loudspeakers may be attached together with tabs, slots, magnets, or the like, and may be detachable such that they may be placed at desired locations. The speakers may also be held together in the speaker array, rather than being physically separated, with speakers at different positions within the array selected for playback so as to achieve desired spatial sound separation.

According to some examples, elements of the speaker array are configured to receive respective playback tracks of the M playback tracks via a programmable switch. In some examples, the programmable switch may have software-defined connections and a control-signal input for connecting specified inputs to respective outputs.

In some examples, the method may further include providing cabling and/or electronic communications between the elements of the speaker array and the programmable switch. If electronic communications are used, elements of the speaker array may be individually powered, e.g., using integrated amplifiers. In such cases, the programmable switch may itself be realized at least in part using software. For example, speaker array elements may have network addresses, such that the programmable switch may direct specified audio tracks to speaker array elements based on address (e.g., Wi-Fi, Bluetooth, or CBRS). Various wired and wireless arrangements are contemplated.

According to some embodiments, the techniques described herein may be applied in real time, or nearly real time, such that the audio performance may be delivered live at the originating location and quasi-live at the listening venue, nearly simultaneously with the live performance. According to some variants, multiple quasi-live instances may be rendered at respective locations at the same time, or nearly so, e.g., by broadcasting captured audio tracks to multiple listening venues and rendering the audio at the respective venues.

According to some embodiments, live-sounding audio may be provided as a service. For example, libraries of recorded audio captured using the above techniques may be stored in the cloud or elsewhere on a network-connected server (or multiple such servers) and made available for download on demand. Downloaded audio may then be reproduced at a desired listening venue as described above. Thus, the corpus of existing original multi-tracks (as opposed to mixes or remixes) may be suitably transformed to produce a live feel.

According to some embodiments, a variant of the above-described technique includes receiving multiple audio tracks of an audio recording and providing a user interface that enables a user to mix and/or modify the audio tracks to produce a multi-channel audio signal based on the user's own settings. The audio recording can be a new recording or performance or an old (legacy) recording. For example, users can receive multi-track audio of popular, multi-track music recordings and create their own mixed versions. The mixed versions can emphasize or suppress particular tracks, based on the user's settings, allowing the users to be active participants in creating the music. In addition, using the above-described techniques, mixed versions may be played back at listening venues to render them as live-sounding performances.

According to some embodiments, spatially separated sound sources may be captured while filming a scene that involves both audio and video. The video of the scene may be played back at another time and/or place, e.g., using a television, video monitor, projector, or the like, and the audio of the scene may be played back using the above-described techniques. Live effects can thereby be introduced into multimedia performances.

FIG. 1 shows an example environment 100 in which embodiments of the improved technique hereof can be practiced. Apparatus for sound capture at an originating location 102 are shown at the top of FIG. 1, and apparatus for sound production at a listening venue 104 are shown at the bottom of FIG. 1.

As shown at the top of FIG. 1, multiple audio sources 110 (AS-1, AS-2, AS-3, and so forth; also referred to herein as "sound sources") provide respective audio signals. The audio signals may convey, for example, audio from vocalists, instruments, and other sound sources. An ADC (analog-to-digital converter)/mixer 120 receives the audio signals, digitizes them, and optionally mixes them, producing tagged audio tracks 122. For example, if there are N sound sources 110, there may be N tagged audio tracks 122. Alternatively, there may be fewer than N tagged audio tracks 122. For example, the mixer may combine the output of certain sound sources 110. The tagging may provide information relevant to reproduction and may be performed by any of the equipment at the originating location.

Computer 130 receives the tagged audio tracks 122, e.g., via FireWire, USB, or the like, and encodes them, e.g., via multi-track encoder 140, to produce encoded tagged audio tracks 142. Encoding may be lossless or lossy. In some examples, encoding is protected by Blockchain technology. One should appreciate that there are multiple ways for electronic equipment to carry out the described functions, and that the one shown is merely an example.

Computer 130 is seen to include a set of processors 132 (e.g., one or more processing chips or assemblies), a set of communication interfaces 134 (e.g., an Ethernet and/or Wi-Fi adapter), and memory 136. The memory 136 may include both volatile memory, e.g., RAM (Random Access Memory), and non-volatile memory, such as one or more ROMs (Read-Only Memories), disk drives, solid state drives, and the like. The set of processors 132 and the memory 136 together form control circuitry, which is constructed and arranged to carry out various methods and functions as described herein. Also, the memory 136 includes a variety of software constructs realized in the form of executable instructions. When the executable instructions are run by the set of processors 132, the set of processors 132 is made to carry out the operations of the software constructs. Although certain software constructs are specifically shown and described, it is understood that the memory 136 typically includes many other software components, which are not shown, such as an operating system, various applications, processes, and daemons. Also, although shown as a general-purpose computer, the functionality of computer 130 may alternatively be realized using customized hardware and/or firmware, such as using one or more FPGAs (Field-Programmable Gate Arrays), ASICs (Application-Specific Integrated Circuits), and/or the like.

In the example shown, encoded tracks 142 are sent over the network 150 to the listening venue 104, where they may be reproduced. In some examples, the encoded tracks may be stored in cloud storage 152, e.g., so that they may be downloaded on demand.

At the listening location 104, a computer 160 receives the encoded tracks 142. Multi-track decoder 170, which may run on computer 160, decodes the tracks. Tagging may be accessed and applied. Optionally, one or more filters 172 may be configured (based on tagging) to modify the sounds of particular tracks. For example, filters 172 may simulate particular amplifiers or speaker sets.

The computer 160 may be constructed as described above for computer 130, e.g., by including a set of processors 162, a set of communication interfaces 164, and memory 166, which may be configured as described above. Alternatively, the computer 160 may be implemented using one or more FPGAs, ASICs, or the like.

As further shown in FIG. 1, multi-track DAC (digital-to-analog converter) 174 converts the tracks to analog form. Programmable switch 180 switches the analog signals to playback units 190. Speaker elements within the playback units 190 may be selected for particular tracks, based on tagging. For example, a track tagged as a snare drum may be directed to one type of speaker, and a track tagged for a bass guitar may be switched to another. Speakers may be grouped together for certain tracks, with different groupings applied to different tracks.

In some examples, the playback units 190 include both amplifiers and loudspeakers. In some examples, the loudspeakers may be separated and moved to desired locations, e.g., to better match the locations of respective performers at the originating location 102. Some speakers may be placed on the floor (e.g., to mimic guitar amps), while others may be placed above the ground (e.g., to mimic vocalists).

One should appreciate that many physical implementations have been contemplated and that the depicted arrangement is just one of many possibilities. The depicted arrangement is not intended to be limiting. Also, any desired amplifiers and speakers may be used, however, with the depicted playback units 190 being merely an example.

Figure 2:
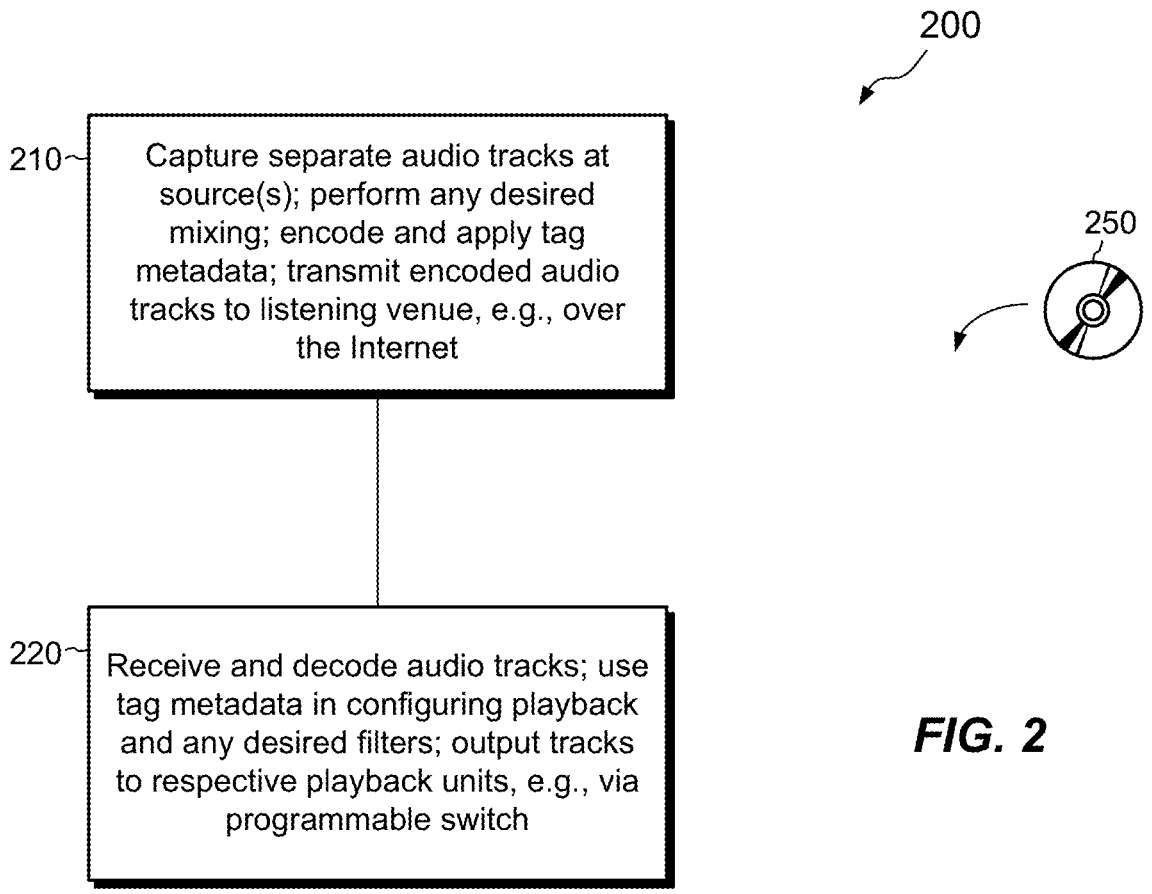
FIG. 2 is a flowchart showing an example method that may be carried out in the environment of FIG. 1.

FIG. 2 shows an example method 200 that may be carried out in connection with the environment of FIG. 1. The method 200 may involve any number of originating locations 102 and any number of listening venues 104.

At 210, separate audio tracks are captured at one or more originating locations 102. The audio tracks may be mixed and encoded. Tagging may be applied, and the encoded tracks may be transmitted to the listening venue 104, e.g., over the network 150.

At 220, the encoded audio tracks are received and decoded at the listening venue 104. Tag metadata 122*a* is used to configure playback and any desired filters 172. Decoded tracks are directed to respective playback units, e.g., via the programmable switch 180.

In various examples, step 220 may include receiving multiple audio tracks 142 of respective sound sources 110, decoding the audio tracks 142, and providing the decoded audio tracks 170*a* to respective playback units 190 at a listening venue 104 for reproducing respective audio.

In some examples, reproducing respective audio at the listening venue 104 is performed in real time substantially simultaneously with capturing the audio tracks at the originating location 102. In this manner, a performance at the originating location 102 is played substantially live at the listening venue 104, such that the playback at the listening venue 104 is a live, remotely-sourced performance.

In some examples, the listening venue 104 is a first listening venue, and the method 200 further includes transmitting the encoded audio tracks 142 over the network 150 to a second listening venue 104*a* apart from the first listening venue 104. The second listening venue may include the same or similar components as those shown in the first listening venue 104. The method 200 may further include decoding the audio tracks 142 of the respective sound sources 110 at the second listening venue and providing the decoded audio tracks 170*a* to respective playback units 190 at the second listening venue 104*a* for reproducing respective audio of the decoded audio tracks 170*a*. One should appreciate that greater than two listening venues may be provided.

In some examples, step 210 of method 200 further includes transmitting tag metadata 122*a* with the audio tracks. The tag metadata 122*a* specifies at least one of (i) spatial locations of one or more sound sources 110, (ii) amplifier and/or speaker types through which the respective tracks 142 are to be played back, and/or (iii) characteristics of microphones used to capture the sound sources 110. In some examples, the tag metadata 122*a* specifies both audio and acoustic characteristics of a microphone used to capture one of the sound sources 110.

In some examples, the sound sources 110 are disposed at respective locations at the originating location 102, and the method 200 further includes placing the playback units 190 at corresponding locations at the listening venue 104. In this manner, placement of the playback units 190 at the listening venue 104 substantially matches placement of the sound sources 110 at the originating location 102, further contributing to the realism of the sound production at the listening venue 104.

In some examples, the method 200 further includes capturing video at the originating location 102, transmitting the video to the listening venue 104 over the network 150, and reproducing the video at the listening venue 104. Where multiple listening venues are provided, video may be transmitted to any number of such venues, where the video is reproduced along with the audio, thereby providing a remotely-sourced, live, multi-media performance.

Some examples further include storing the encoded audio tracks 142 on a server on the network, such as on the cloud server 152, and providing the encoded audio tracks 142 for download over the network 150. In some arrangements, users can download encoded audio tracks 142 from the cloud server 152 and apply their own user-defined settings to create their own mixes of audio to suit their own tastes.

In some examples, the cloud server 152 stores tracks of well-known recordings, such as legacy recordings (e.g., classic rock, jazz favorites, etc.). Users may download the tracks of such recordings and create their own custom mixes, thus applying their own creativity to enhance such recordings.

Method 200 may include various further acts as part of step 220. For example, receiving the audio tracks 142 may include receiving tag metadata 122*a* associated with the respective audio tracks 142. In such cases, the method 200 further includes applying the tag metadata 122*a* in reproducing the audio tracks 142.

In some examples, the tag metadata 122*a* for one of the audio tracks specifies characteristics of a filter 172 to be applied in reproducing the audio track. Applying the tag metadata 122*a* in such cases may include configuring a filter that applies the specified characteristics. For example, the filter may be one designed to simulate a preexisting guitar amp and/or speaker.

Some examples may include merging together audio tracks received at the listening venue 104. For example, the received audio tracks may include N audio tracks, and the method 200 merges the N audio tracks into M audio tracks, M<N. In an example, audio tracks are merged together based at least in part on their not distorting each other, and/or based at least in part on there being little benefit to keeping the tracks separate, as doing so does not contribute much to spatial realism.

Figure 4:
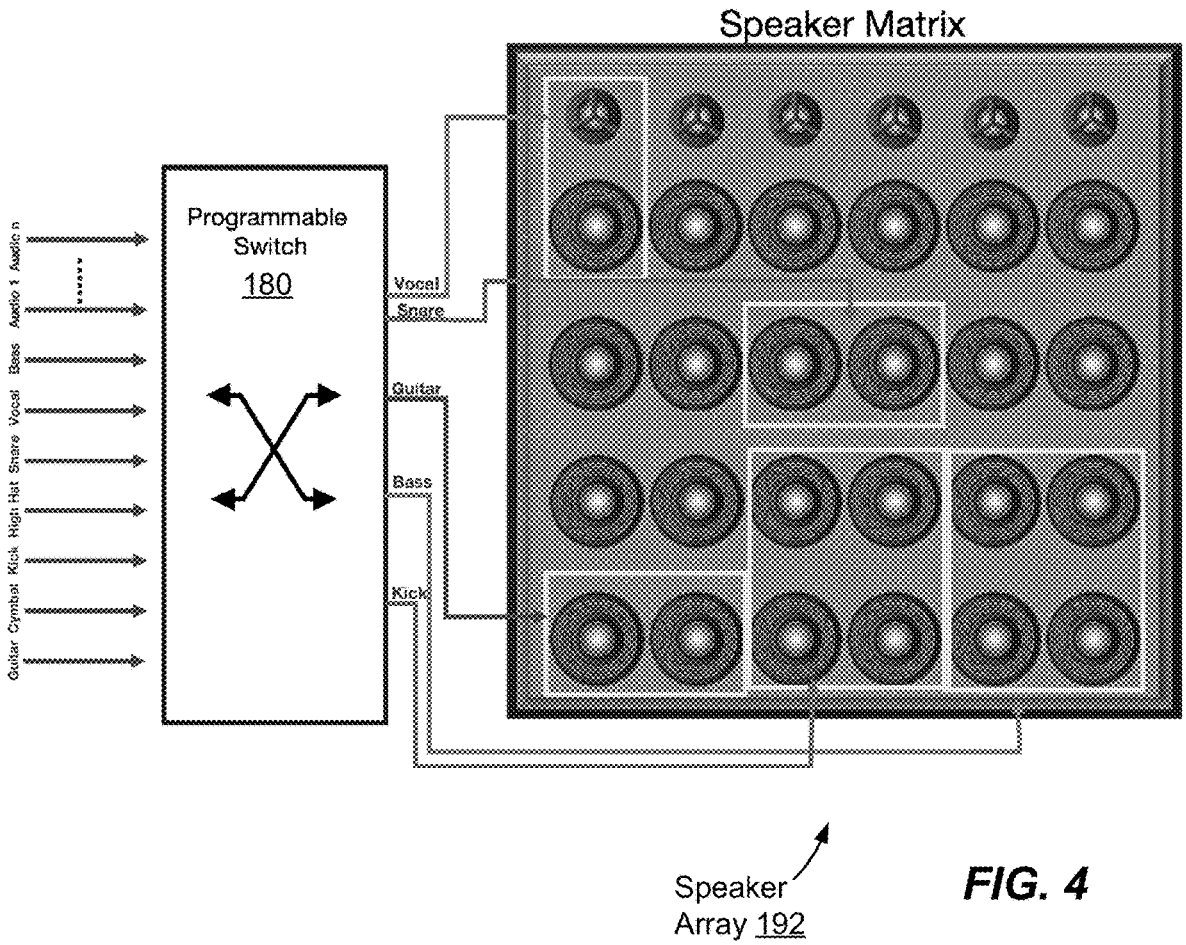
FIG. 4 is a block diagram showing an example programmable switch and speaker array, which may be used in some embodiments.

In some examples, the method 200 includes providing the playback units 190 as respective sets of loudspeakers in a reconfigurable speaker array 192, also referred to herein as a "speaker matrix" (see FIG. 4). The reconfigurable speaker array 192 may include loudspeakers at multiple heights and multiple horizontal separations. In such cases, placing the playback units at corresponding locations at the listening venue 104 includes selecting loudspeakers of the reconfigurable speaker array 192 at locations that correspond, at least approximately, to locations of sound sources 110 at the listening venue 102.

Some examples may include separating one or more loudspeakers, such as loudspeaker 192*a*, from the reconfigurable speaker array 192, and placing said one or more loudspeakers at respective locations apart from the reconfigurable speaker array 192. In this manner, loudspeaker 192*a* may be more accurately placed, e.g., placed at a location in the listening venue 104 that corresponds more accurately with the location of the associated sound source 110 at the originating location 102.

Figure 3:
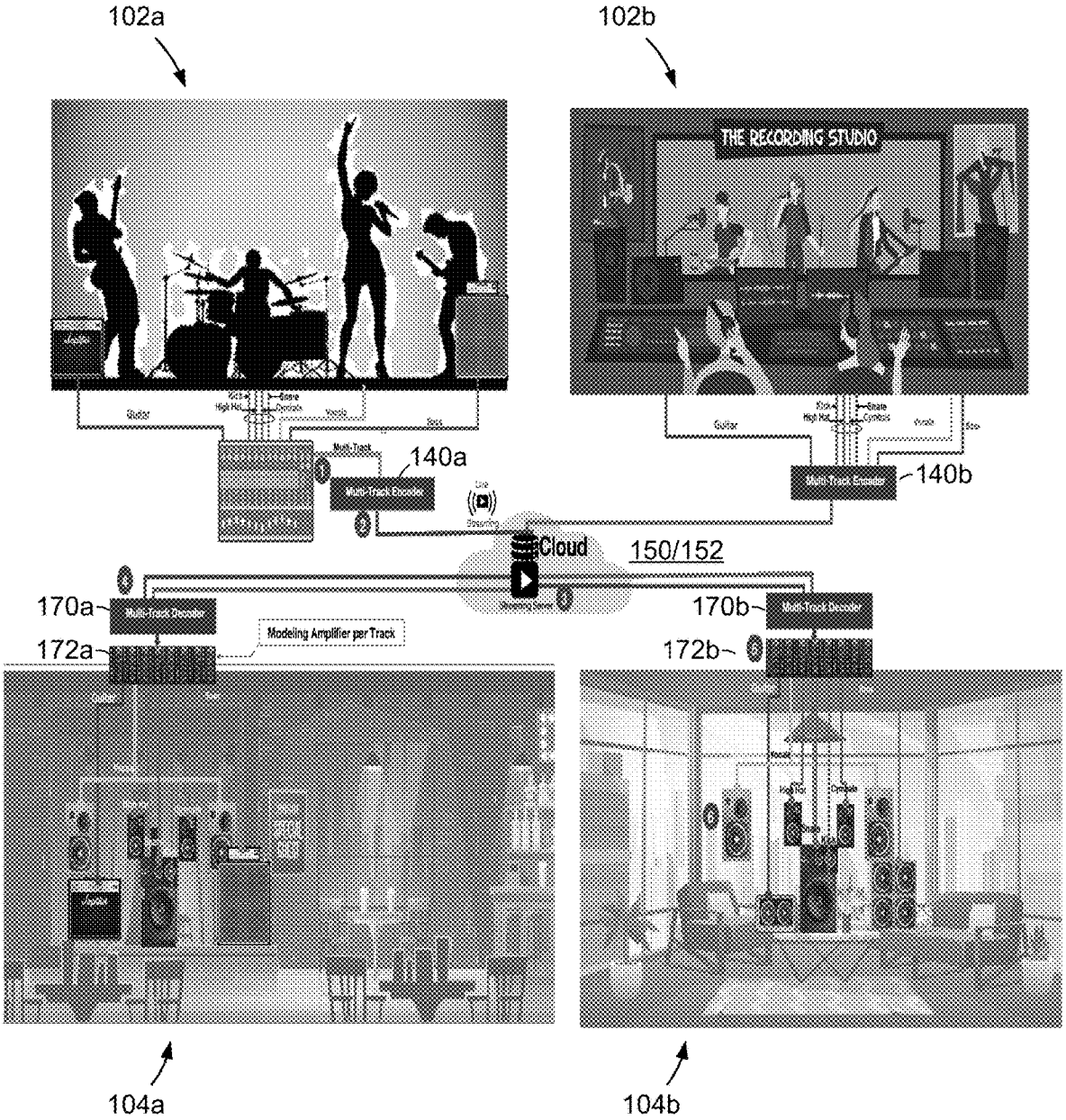
FIG. 3 is a block diagram showing example use cases for practicing aspects of the invention.

FIG. 3 shows various example scenarios in which the method 200 of FIG. 2 may be practiced. In one example, originating location 102*a* depicts a live band performance. Various tracks (e.g., guitar, high hat, kick, snare, cymbals, vocals, and bass) may be acquired from respective pickups, microphones, or the like, and encoded by multi-track encoder 140*a*. Tag metadata 122*a* may be created to capture settings and/or details of the setup at location 102*a*. Encoded tracks and associated metadata may be sent over network 150 to one or more listening venues, such as venue 104*a*. There, multi-track decoder 170*a* decodes the respective tracks. Tag metadata 122*a* may be read and applied, e.g., to configure filters 172*a*. For example, filters 172*a* simulate some or all of the same amplifiers and/or speakers that were used in the live performance at location 102*a*. Loudspeakers may be placed at locations within the venue 104*a* that correspond to locations of the respective instruments and/or performers at location 102*a*. Although no performers are present at the venue 104*a*, the performance sounds live because (i) the locations of the instruments and performers correspond across the two locations and (ii) the filters make the amps and speakers at the venue 104*a* sound very much like those at the source 102*a*.

Preferably, sound is captured as close to the sound sources 110 as practicable at the originating location 102*a*. In this manner, captured audio is an accurate representation of what is input to amplifiers and speakers at location 102*a*. The same sound may then be played back at venue 104*a* using simulated versions of the same or similar amplifiers and/or speakers. With this arrangement, audio is reproduced at the venue 104*a* the same way that audio at the source 102*a* is produced, i.e., by playing corresponding sound sources through similar-sounding equipment at similar locations.

Rather than using filters 172*a*, the venue 104*a* may instead use the same or similar makes and models of amplifiers and speakers as were used for the respective instruments and performers at the originating location 102*a*. In this manner, realism is enhanced even further. In some examples, a hybrid approach is taken. For example, some sound sources 110 may be enhanced using filters, whereas others may use the same or similar amps and/or speakers at the venue 104*a* as at the originating location 102*a*.

One should appreciate that the same encoded tracks and tag metadata as are sent to listening venue 104*a* may also be sent to listening venue 104*b*. At venue 104*b*, a multi-track decoder 170*b* decodes the respective tracks, and a filter bank 172*b* applies any desired filters, e.g., to simulate the same amps and loudspeakers used at the source 102*a*. At venue 104*b*, the placement of loudspeakers corresponds to the placement of instruments and/or musicians at the originating location 102*a*. Thus, a similar live-sounding performance can be achieved at venue 104*b* as was achieved at venue 104*a*.

A performance may also be captured at a recording studio, such as that shown at originating location 102*b*, where sound sources are encoded using multi-track encoder 140*b*. Tracks may be transmitted live to one or more listening venues (e.g., 104*a* and/or 104*b*), and reproduced in the manner described for location 102*a*. Alternatively, tracks captured at location 102*b* may be stored in the cloud 152, where the tracks may be available for download at a later time. Thus, live-sounding audio recorded at one time may be reproduced at a later time at locations 104*a* and/or 104*b*.

FIG. 4 shows an example programmable switch 180 and speaker array 192 in greater detail. Here, the programmable switch 180 has multiple inputs (shown to the left of switch 180), which receive respective decoded audio tracks, e.g., analog signals providing the respective tracks. The programmable switch connects, e.g., under control of computer 160, the inputs to respective outputs (shown to the right of switch 180). The outputs are coupled to respective speakers or sets of speakers in the speaker array 192. In an example, connections of the speaker array 192 are software-defined and subject to one or more control signals from the computer 160.

In an example, the programmable switch 180 supports full-crosspoint switching, e.g., switching of any input to any output, with each output connected to a respective speaker in the array 192. Full-crosspoint switching is not required, however.

In some examples, cabling and/or electronic communications may be provided between the programmable switch and the speakers in the speaker array 192. If electronic communications are used, elements of the speaker array may be individually powered, e.g., using integrated amplifiers. In such cases, the programmable switch 180 may itself be realized at least in part using software. For example, individual speakers may have network addresses, such that the programmable switch may direct specified audio tracks to speaker array elements based on address, such as Wi-Fi, Bluetooth, or CBRS (Citizens Broadband Radio Service). Various wired and wireless arrangements are contemplated.

In an example, the programmable switch 180 is configured to connect tracks to speakers based on bandwidth requirements and location. For example, instruments or performers that produce only high frequencies may be switched to smaller speakers, whereas instruments or performers that produce only low frequencies may be switched to larger speakers. In addition, the programmable switch 180 may take instrument/performer locations at the originating location 102 into account when associating tracks with speakers. For example, a speaker located near the top-left of the speaker array 192 may be associated with a performer located to the left of a stage at location 102 and at a similar height.

In some examples, the programmable switch 180 may connect a track to multiple speakers, e.g., to achieve higher volume and/or lower frequency. In addition, mid-range drivers and tweeters may both be selected for instruments and/or vocals that combine mid-range and high frequencies.

Figure 5A:
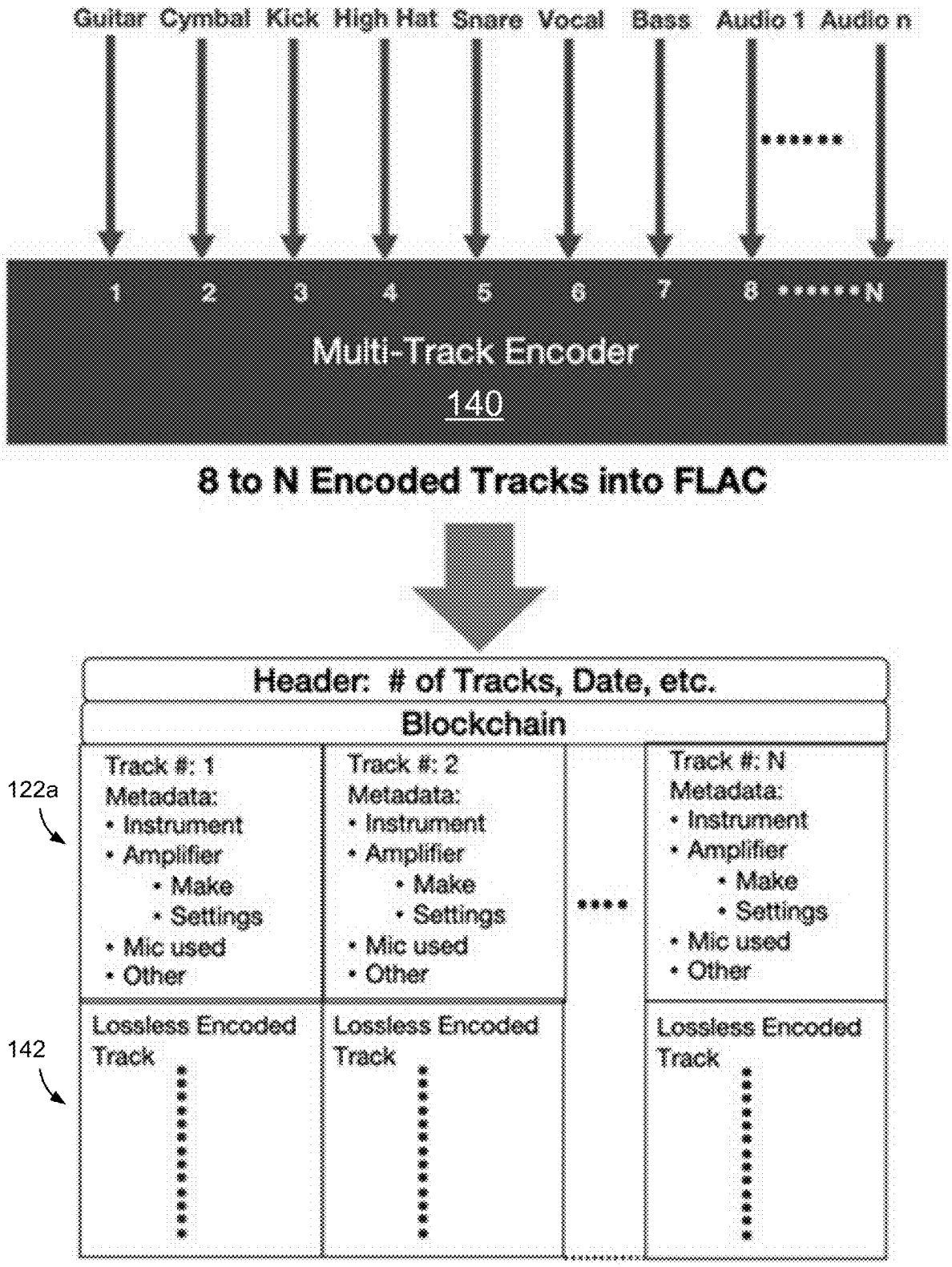
FIGS. 5A and 5B are diagrams that show example generation (FIG. 5A) and application (FIG. 5B) of tag metadata, which may be provided in some embodiments.
Figure 5B:
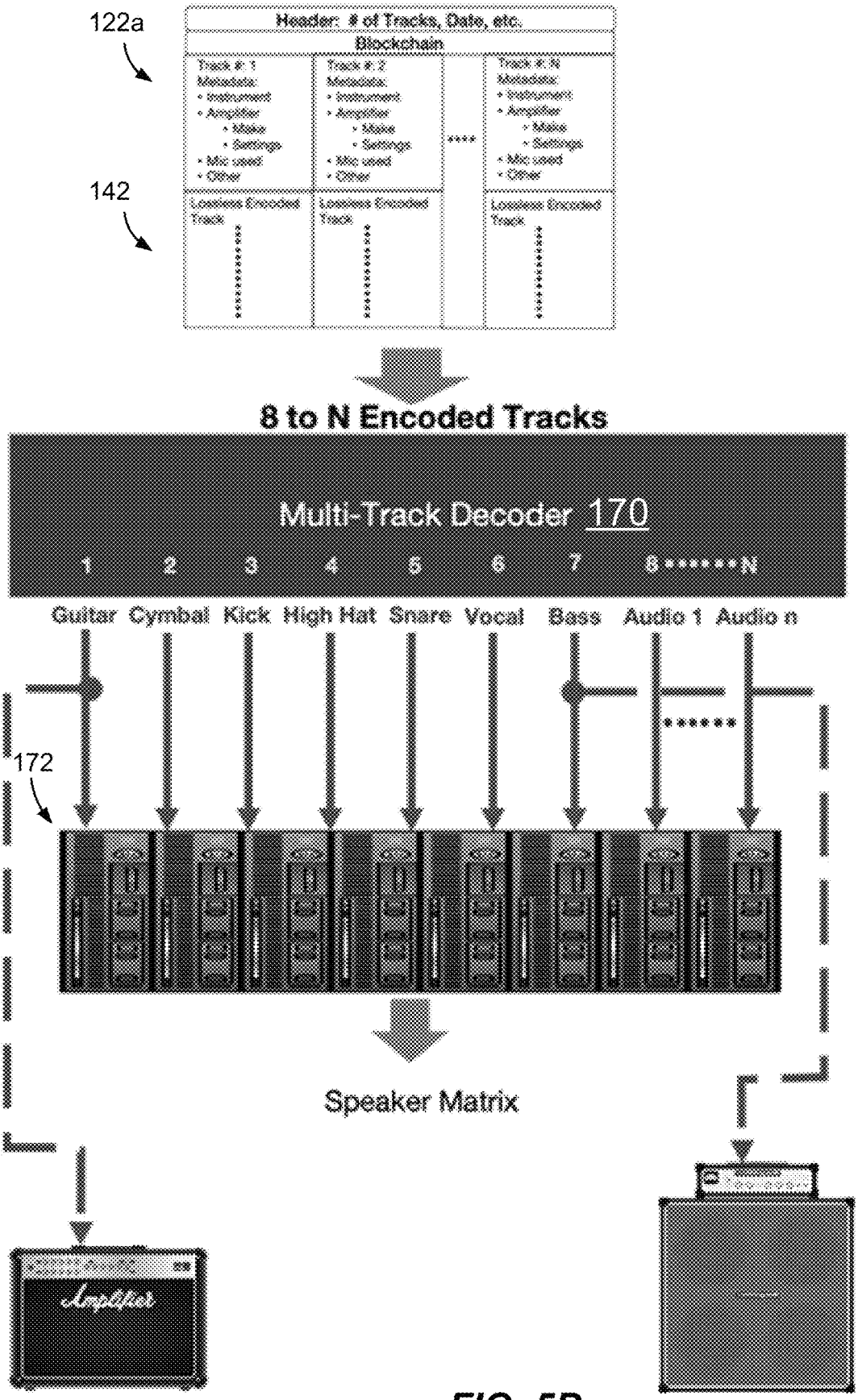

FIGS. 5A and 5B show example generation (FIG. 5A) and application (FIG. 5B) of tag metadata 122*a*. As shown in FIG. 5A, multi-track encoder 140 may receive tagged audio tracks (FIG. 1) and generate encoded audio tracks 142 with associated tag metadata 122*a*. As shown, tag metadata 122*a* may be provided on a per-track basis and may include audio settings, such as tone, EQ pan, and the like. It may further include location information, which identifies the location of the sound source 110 of the respective track within the originating location 102. In an example, audio tracks themselves may be losslessly encoded to preserve maximum fidelity. Audio tracks 142 and associated tag metadata 122*a* may be packaged together and protected, for example, using Blockchain technology.

As shown in FIG. 5B, tag metadata 122*a* may be applied at the listening venue 104, e.g., by configuring filters 172 and by selecting specified components, e.g., amplifiers and speakers. Tag metadata 122*a* may also be applied by placing speakers at indicated locations, i.e., at locations within the listening venue 104 that match locations of respective sound sources 110 at the originating location 102.

Figure 6A:
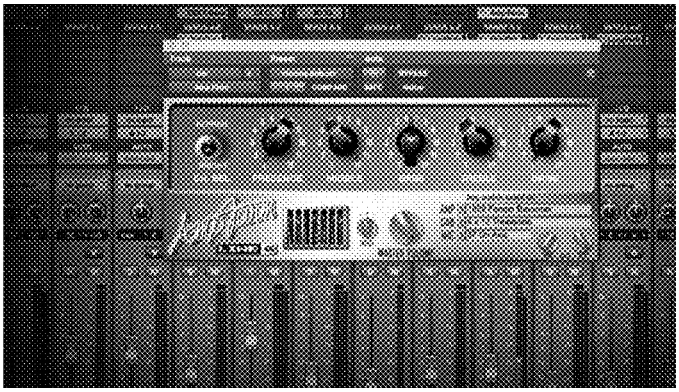
FIGS. 6A-6C shown examples of amplifier filters that may be used in certain embodiments.
Figure 6B:
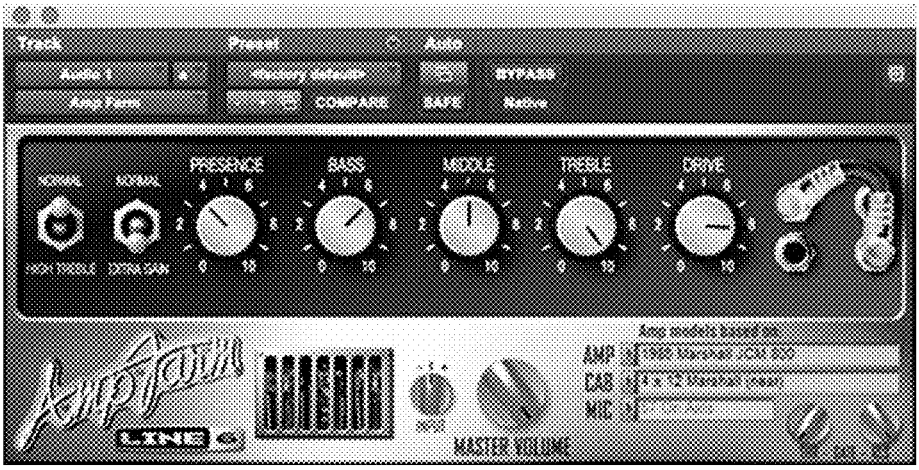
Figure 6C:
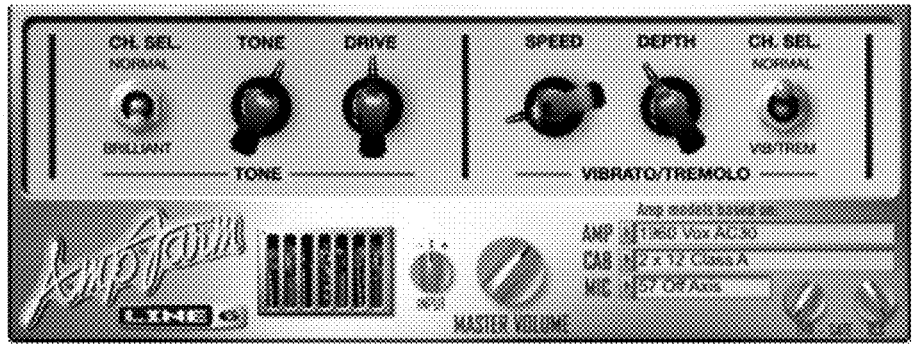

FIGS. 6A-6C show examples of amplifier filters that may be used as filters 172 in certain embodiments. Various filters may be selected, such as 1959 Fender Bassman (FIG. 6A), 1986 Marshall JCM 800 (FIG. 6B), or 1960Vox AC30 (FIG. 6C). Other filters (not shown) may include the following:

1964 Fender "Blackface" Deluxe
1967 Fender "Blackface" Twin
1966 Vox AC30 with Top Boost
1965 Marshall JTM45
1968 Marshall Plexi
1995 Mesa/Boogie "Recto" Head
1994 Mesa/Boogie Trem-O-Verb
1989 Soldano SLO Head
1987 Soldano X-88R Preamp
1996 Matchless Chieftain Filters may be provided for guitars, bass guitars, and/or other instruments. In addition, filters may be provided for simulating certain commercially-available microphones. Thus, the examples of FIGS. 6A-6C are intended to be illustrative rather than limiting.

An improved technique has been described for producing audio, which includes providing multiple audio tracks 142 of respective sound sources 110 of an audio performance and rendering a sound production of the audio performance at a listening venue 104 by playing back the audio tracks 142 on respective playback units 190.

Having described certain embodiments, numerous alternative embodiments or variations can be made. Further, although features are shown and described with reference to particular embodiments hereof, such features may be included and hereby are included in any of the disclosed embodiments and their variants. Thus, it is understood that features disclosed in connection with any embodiment are included as variants of any other embodiment.

Further still, the improvement or portions thereof may be embodied as a computer program product including one or more non-transient, computer-readable storage media, such as a magnetic disk, magnetic tape, compact disk, DVD, optical disk, flash drive, SD (Secure Digital) chip or device, Application Specific Integrated Circuit (ASIC), Field Programmable Gate Array (FPGA), and/or the like (shown by way of example as medium 250 in FIG. 2). Any number of computer-readable media may be used. The media may be encoded with instructions which, when executed on one or more computers or other processors, perform the process or processes described herein. Such media may be considered articles of manufacture or machines, and may be transportable from one machine to another.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Further, although ordinal expressions, such as "first," "second," "third," and so on, may be used as adjectives herein, such ordinal expressions are used for identification purposes and, unless specifically indicated, are not intended to imply any ordering or sequence. Thus, for example, a second event may take place before or after a first event, or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Although certain embodiments are disclosed herein, it is understood that these are provided by way of example only and that the invention is not limited to these particular embodiments.

Those skilled in the art will therefore understand that various changes in form and detail may be made to the embodiments disclosed herein without departing from the scope of the invention.

What is claimed is:

1. A method of producing audio, comprising:

receiving (i) multiple audio tracks of respective sound sources disposed at an originating location and (ii) tag metadata associated with the respective audio tracks, the tag metadata including location information indicating relative locations of the sound sources at the originating location;

decoding the audio tracks; and providing the decoded audio tracks to respective playback units at a listening venue for reproducing respective audio of the decoded audio tracks, wherein the method further comprises placing the playback units, based on the location information of the tag metadata, at relative locations at the listening venue that substantially match the relative locations of the sound sources at the originating location.

2. The method of claim 1, wherein the tag metadata for one of the audio tracks further specifies characteristics of a filter to be applied in reproducing said one of the audio tracks, and wherein the method further comprises configuring a filter that applies the specified characteristics.

3. The method of claim 2 wherein configuring the filter includes simulating a preexisting guitar amp and/or speaker.

4. The method of claim 1, wherein the multiple audio tracks include N audio tracks, wherein the method further comprises merging the N audio tracks to M merged audio tracks, M<N, and wherein audio tracks are merged based at least in part on their not distorting each other.

5. The method of claim 1, further comprising providing the playback units as respective sets of loudspeakers in a reconfigurable speaker array.

6. The method of claim 5, wherein the reconfigurable speaker array includes loudspeakers at multiple heights and multiple horizontal separations, and wherein placing the playback units at the relative locations at the listening venue includes selecting loudspeakers of the reconfigurable speaker array at locations that correspond to locations of sound sources at the listening venue.

7. The method of claim 6, wherein placing the playback units at the relative locations at the listening venue further includes separating one or more loudspeakers from the reconfigurable speaker array and placing said one or more loudspeakers at respective locations apart from the reconfigurable speaker array.

8. The method of claim 1, wherein the multiple audio tracks are received in real time from the originating location as part of a live performance at the originating location.

9. The method of claim 1, wherein receiving the multiple audio tracks of respective sound sources includes downloading the multiple audio tracks from a cloud server.

10. The method of claim 9, further comprising mixing the audio tracks as received from the cloud server in accordance with user-defined settings.

11. The method of claim 1, wherein the sound sources are disposed at relative horizontal separations at the originating location, and wherein placing the playback units at corresponding locations at the listening venue includes placing the playback units at substantially the same horizontal separations.

12. A method of providing a remotely-sourced, live performance, comprising:

separately capturing audio tracks from respective sound sources at an originating location;

encoding the captured audio tracks;

transmitting the encoded audio tracks and associated tag metadata over a network to a listening venue, the tag metadata including location information indicating relative locations of the sound sources at the originating location;

decoding the audio tracks of the respective sound sources at the listening venue;

providing the decoded audio tracks to respective playback units at the listening venue for reproducing respective audio of the decoded audio tracks; and placing the playback units, based on the location information of the tag metadata, at relative locations at the listening venue that substantially match the relative locations of the sound sources at the originating location.

13. The method of claim 12, wherein reproducing the respective audio at the listening venue is performed in real time substantially simultaneously with capturing the audio tracks at the originating location.

14. The method of claim 13, wherein the listening venue is a first listening venue, and wherein the method further comprises:

transmitting the encoded audio tracks over the network to a second listening venue apart from the first listening venue;

decoding the audio tracks of the respective sound sources at the second listening venue; and providing the decoded audio tracks to respective playback units at the second listening venue for reproducing respective audio of the decoded audio tracks.

15. The method of claim 12, where the tag metadata further specifies at least one of:

(i) amplifier and/or speaker types through which the respective tracks are to be played back; or (ii) characteristics of microphones used to capture the sound sources.

16. The method of claim 12, wherein the tag metadata further specifies both audio and acoustic characteristics of a microphone used to capture one of the sound sources.

17. The method of claim 12, further comprising:

capturing video at the originating location;

transmitting the video to the listening venue over the network; and reproducing the video at the listening venue.

18. The method of claim 12, further comprising storing the encoded audio tracks on a server on the network and providing the encoded audio tracks for download over the network.

19. The method of claim 11, wherein the sound sources are disposed at respective heights at the originating location, and wherein the method further comprises placing the playback units at substantially the respective heights at the listening venue.

* * * * *